US006736393B2

(12) United States Patent
Noh

(10) Patent No.: US 6,736,393 B2
(45) Date of Patent: May 18, 2004

(54) MEDIUM STACKER

(75) Inventor: Seung-Kyoon Noh, Seoul (KR)

(73) Assignees: KRDC Co., Ltd., Seoul (KR); Gradco (Japan) Ltd., Tokyo (JP)

( * ) Notice: Subject to any disclaimer, the term of this patent is extended or adjusted under 35 U.S.C. 154(b) by 0 days.

(21) Appl. No.: 10/259,411

(22) Filed: Sep. 30, 2002

(65) Prior Publication Data

US 2003/0080498 A1 May 1, 2003

(51) Int. Cl.[7] ..... B65H 31/04
(52) U.S. Cl. ..... 271/214; 271/215; 271/219
(58) Field of Search ..... 271/213, 214, 271/215, 152, 176, 199, 219; 399/405; 162/269; B65H 31/14, 43/04, 31/04, 1/08, 43/00

(56) References Cited

U.S. PATENT DOCUMENTS

| | | | | | |
|---|---|---|---|---|---|
| 4,357,127 | A | * | 11/1982 | Kooiman | 312/71 |
| 5,090,681 | A | * | 2/1992 | Henn et al. | 271/218 |
| 5,150,818 | A | * | 9/1992 | DeMoss | 221/228 |
| 5,186,454 | A | * | 2/1993 | Kitahara | 271/288 |
| 5,572,293 | A | * | 11/1996 | Kikuchi et al. | 399/357 |
| 5,882,005 | A | * | 3/1999 | Araseki et al. | 271/126 |
| 6,305,996 | B1 | * | 10/2001 | Detwiler | 440/53 |

FOREIGN PATENT DOCUMENTS

| | | | | |
|---|---|---|---|---|
| JP | 59-102755 | * | 6/1984 | B65H/31/14 |
| JP | 2-62326 | * | 3/1990 | B65H/1/14 |
| JP | 2-282161 | * | 11/1990 | B65H/31/14 |

* cited by examiner

*Primary Examiner*—Donald P. Walsh
*Assistant Examiner*—Kenneth W. Bower
(74) *Attorney, Agent, or Firm*—McGuireWoods LLP

(57) ABSTRACT

A medium stacker is disclosed, which has a structure that effectively processes load externally applied to a stacker tray so as to prevent damage of the medium stacker and an external object from occurring and increases the ascending range of a stacker tray without change of a power transmission structure. The medium stacker includes a basic module frame fixed to a medium unit of a main body of an output device, a stacker tray fixed to the basic module frame to enable the ascending operation, on which ejected papers are stacked, a first guide means provided in the basic module frame, guiding the ascending operation of the stacker tray, a lifting belt ascending the stacker tray along the first guide means, and a belt driving pulley fixed to the lifting belt. The lifting belt includes a first part moving along the belt driving pulley, having one end fixed to the stacker tray, and a second part of an elastic member which is not moving along the belt driving pulley, having one end fixed to the basic module frame.

8 Claims, 8 Drawing Sheets

MEDIUM STACKER

BACKGROUND OF THE INVENTION

1. Field of the Invention

The present invention relates to a medium stacker for an output device that employs paper, such as a printer and a copier, and more particularly to a medium stacker for an output device in which a detachable expanding module is provided to increase the ascending range of a stacker tray that stacks papers ejected from a main body of the output device and to expand the capacity of the stacker tray.

2. Discussion of the Related Art

A related art medium stacker for a medium unit of an output device that employs paper, such as a copier and a printer, includes a stacker tray that stacks papers ejected to the outside of the output device. The stacker tray ascends with respect to a main body of the output device to stack the papers thereon. The related art medium stacker will be described with reference to FIG. 1.

As shown in FIG. 1, the related art medium stacker includes a stacker tray 107, upper and lower pulleys 103 and 104, a driving motor 105, and a power transmission system 106. The stacker tray 107 is provided to move up and down along a main body frame 101 of an output device by rotation of a closed curve belt 102. The upper and lower pulleys 103 and 104 rotatably fix and support the closed curve belt 102. The driving motor 105 is provided inside the main body frame 101 and provides a rotational force for driving the closed curve belt 102. The power transmission system 106 transmits the rotational force of the driving motor 105 to the lower pulley 104.

The position of the stacker tray 107 is determined by the capacity of stacking the papers ejected from a medium unit 110 of the main body of the output device. If many stacked papers are provided, the stacker tray 107 move downwardly.

The operation of the aforementioned related art medium stacker will be described below.

Papers 10 finished in the main body of the output device are ejected outwardly through the medium unit 110 and then stacked on the stacker tray 107. If a great number of papers are stacked on the stacker tray 107, the stacker tray 107 descends by a predetermined distance so as not to allow the completely stacked papers to interrupt ejection of new papers. That is, if the power is applied to the driving motor 105 in accordance with the capacity of the papers, the rotational force is transmitted to the lower pulley 104 through the power transmission system 106. As a result, the closed curved belt 102 is driven in a direction of arrow "A" and the stacker tray 107 connected with the closed curve belt 102 descends in a direction of arrow "b."

Therefore, the ejected papers 10 can be stacked on the stacker tray 107 without any interrupt of the completely stacked papers.

However, the aforementioned related art medium stacker has several problems.

Since the stacker tray 107 ascends by means of the closed curve belt 102, the ascending operation is limited to the range between the upper and lower pulleys 103 and 104. This limits the number of papers that can be stacked on the stacker tray 107.

To increase the capacity of the papers on the stacker tray 17, it is necessary to increase the length of the closed curve belt 102 by increasing the distance between the upper and lower pulleys 103 and 104. In this case, a new power transmission structure is required.

Moreover, if the stacker tray 107 is in contact with an external object while it descends, the rotational force of the motor 105 acts on the stacker tray 107 through the closed curve belt 102. This may cause overload and damage of the medium stacker or the object which is in contact with the stacker tray 10.

SUMMARY OF THE INVENTION

The present invention is directed to a medium stacker that substantially obviates one or more of the problems due to limitations and disadvantages of the related art.

An object of the present invention is to provide a medium stacker in which a stacker tray ascends by means of a non-closed curve belt having a predetermined length, elastically fixed to a frame so as not to directly transmit a driving force of a motor to the stacker tray if an external force prevents the stacker tray from descending.

Another object of the present invention is to provide a medium stacker in which a detachable expanding module is provided to increase the ascending range of a stacker tray without change of a power transmission structure, thereby increasing the capacity of papers on the stacker tray.

Other object of the present invention is to provide a medium stacker having a structure that effectively processes load externally applied to a stacker tray so as to prevent damage of the medium stacker and an external object from occurring.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, a medium stacker includes a basic module frame fixed to a medium unit of a main body of an output device, a stacker tray fixed to the basic module frame to enable the ascending operation, on which ejected papers are stacked, a first guide means provided in the basic module frame, guiding the ascending operation of the stacker tray, a lifting belt ascending the stacker tray along the first guide means, a belt driving pulley fixed to the lifting belt, and a power transmission system rotating the belt driving pulley, wherein the lifting belt includes a first part moving along the belt driving pulley, fixed to the stacker tray and a second part of an elastic member which is not moving along the belt driving pulley.

The lifting belt has a non-closed curve type in such a way that the first part has one end fixed to the stacker tray and the second has one end fixed to the basic module frame.

The first part of the lifting belt is provided with teeth engaged with the belt driving pulley, and the second part is formed of a spring member.

The medium stacker further includes an expanding module frame detachably fixed to the lower part of the basic module frame, the expanding module frame being provided with a second guide means connected with the first guide means.

The medium stacker further includes a sensing means that senses the position of the stacker tray. The sensing means includes a first sensing plate of a conductive material arranged in the basic module frame in parallel with the first guide means, having slits arranged at predetermined intervals, and a plate spring of a conductive material fixed to the stacker tray, sensing the position of the stacker tray in contact with the slits of the first sensing plate in accordance with the ascending operation of the stacker tray.

The sensing means further includes a second sensing plate of a conductive material arranged in the basic module frame in parallel with the second guide means, having slits arranged at predetermined intervals, and the plate spring senses the position of the stacker tray in contact with the slits of the second sensing plate in accordance with the ascending operation of the stacker tray.

The medium stacker further includes adhesive rollers fixed to adjoin the belt driving pulley, adhering the first part of the lifting belt to the circumference of the belt driving pulley.

It is to be understood that both the foregoing general description and the following detailed description are exemplary and explanatory and are intended to provide further explanation of the invention as claimed.

BRIEF DESCRIPTION OF THE ATTACHED DRAWINGS

The invention will be described in detail with reference to the following drawings in which like reference numerals refer to like elements wherein.

DETAILED DESCRIPTION OF THE PREFERRED EMBODIMENTS

Reference will now be made in detail to the preferred embodiments of the present invention, examples of which are illustrated in the accompanying drawings.

A medium stacker of an output device according to the present invention will be described with reference to FIGS. 2 to 4.

Figure 1:
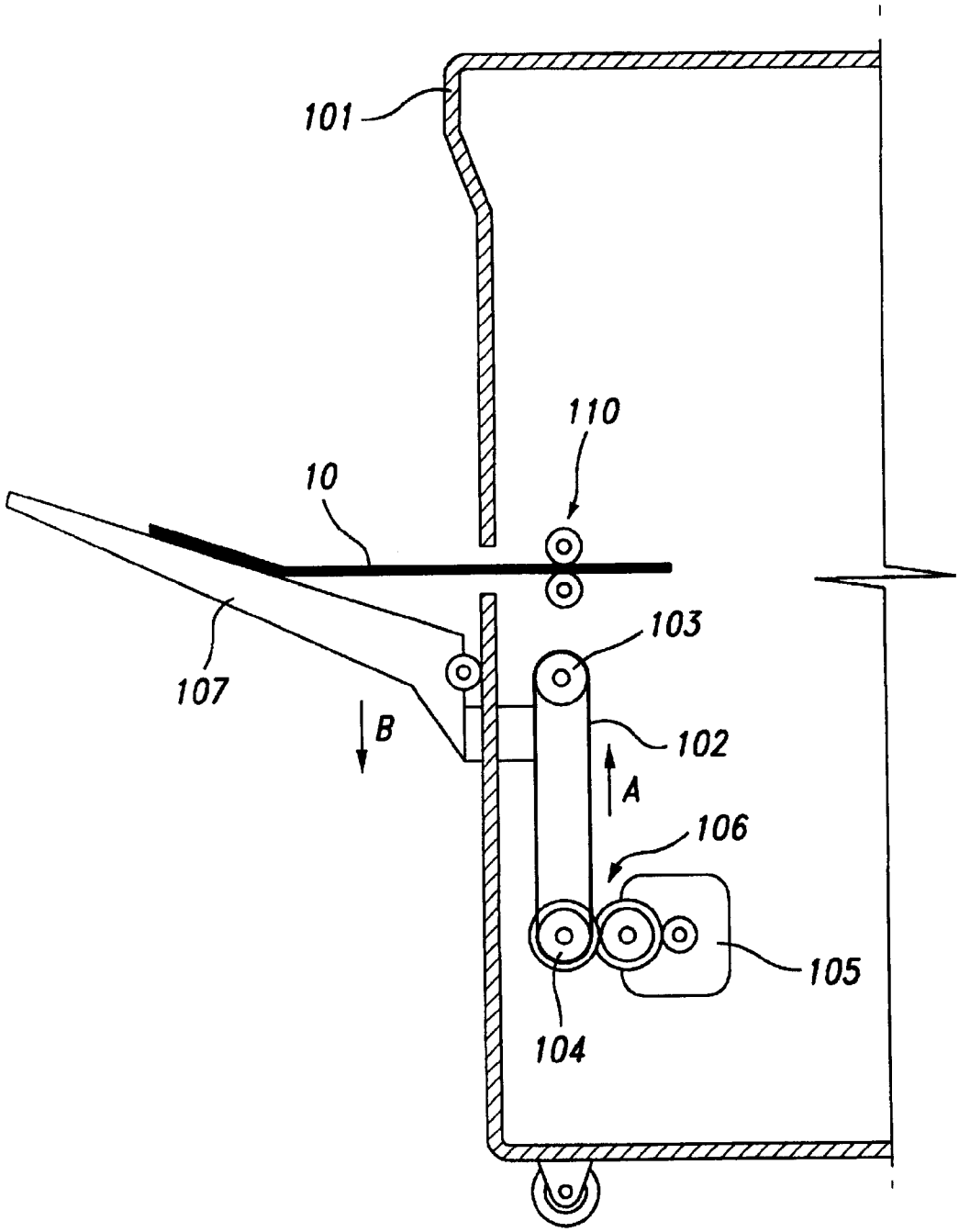
FIG 1 PRIOR ART
FIG. 1 is a side sectional view of a related art medium stacker.
Figure 2:
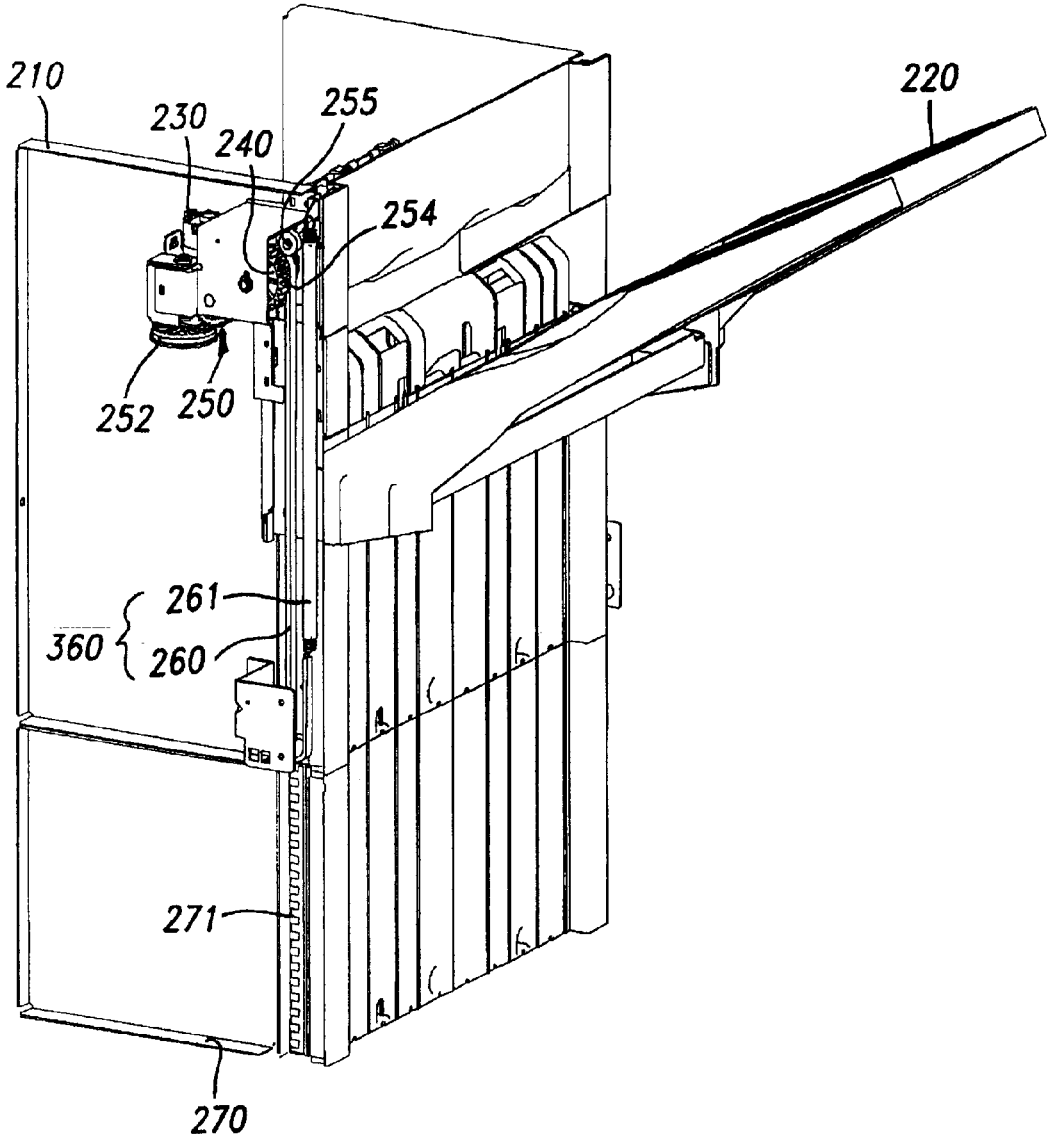
FIG. 2 is a perspective view illustrating a medium stacker of an output device that can expand the capacity of stacking papers in accordance with the present invention.
Figure 3:
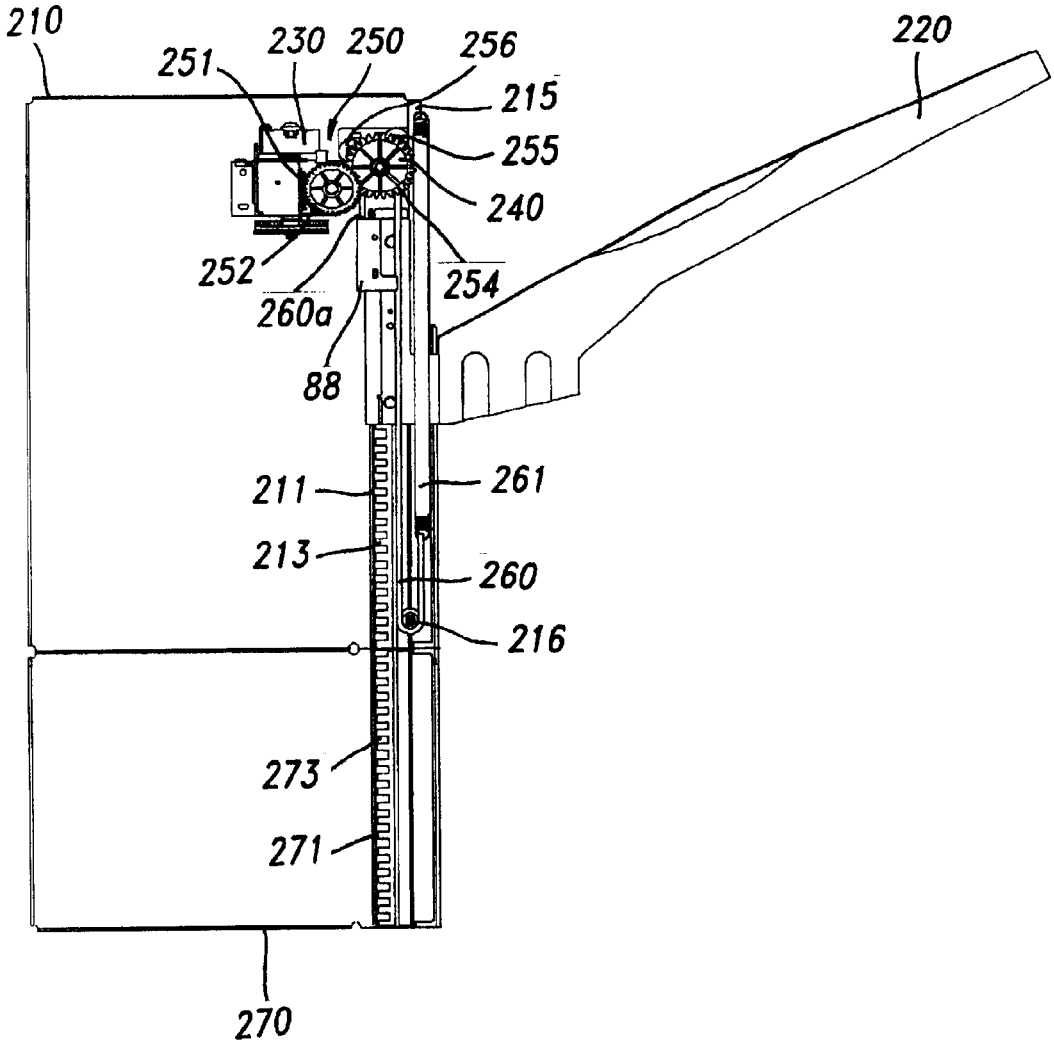
FIG. 3 is a side view illustrating a medium stacker of FIG. 2.
Figure 4:
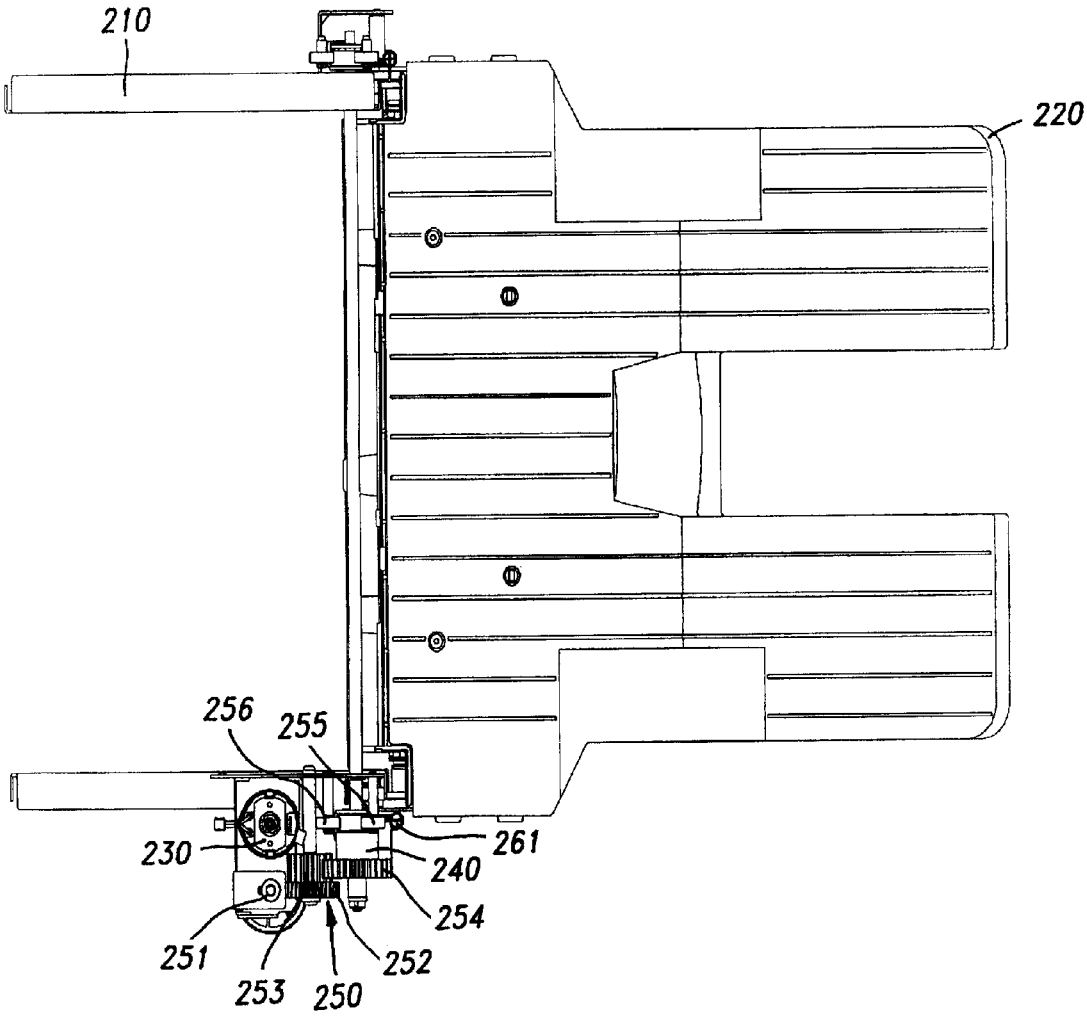
FIG. 4 is a plane view illustrating a medium stacker of FIG. 2.

The medium stacker of an output device according to the present invention, as shown in FIGS. 2 to 4, includes a basic module frame 210 provided with a first guide plate 211 in a vertical direction at both sides, a stacker tray 220 fixed to the basic module frame 210 to enable the ascending operation under the guide of the first guide plate 211, on which ejected papers are stacked, a driving motor 230 fixed onto the basic module frame 210, providing a rotational force for ascending the stacker tray 220, a belt driving pulley 240 fixed to adjoin the driving motor 230 and rotated by the rotational force of the driving motor 230, a power transmission system 250 transmitting the rotational force of the driving motor 230 to the belt driving pulley 240, a non-closed lifting belt 360 consisting of a first part 260 movably engaged with the belt driving pulley 240, having an end fixed to the stacker tray 220, and a second part 261 of an elastic member connected with the first part 261, having an end fixed to the basic module frame 210, and an expanding module frame 270 detachably fixed to the bottom of the basic module frame 210 and provided with a second guide plate 271 connected with the first guide plate 211.

In the embodiment of the present invention, the basic module frame 210 is provided with a first sensing plate 213 of a conductive material arranged in parallel with the first guide plate 211 to sense the position and the operational state of the stacker tray 220. The first sensing plate 213 has slits cut at predetermined intervals.

The expanding module frame 270 is provided with a second sensing plate 273 of the same conductive material as that of the first sensing plate 213. The second sensing plate 273 is arranged in parallel with the second guide plate 271.

Desirably, for exact power transmission, the first part 260 of the lifting belt 360 and the belt driving pulley 240 include a timing belt and a timing pulley, respectively. The timing belt and the timing pulley are provided with teeth.

Figure 8:
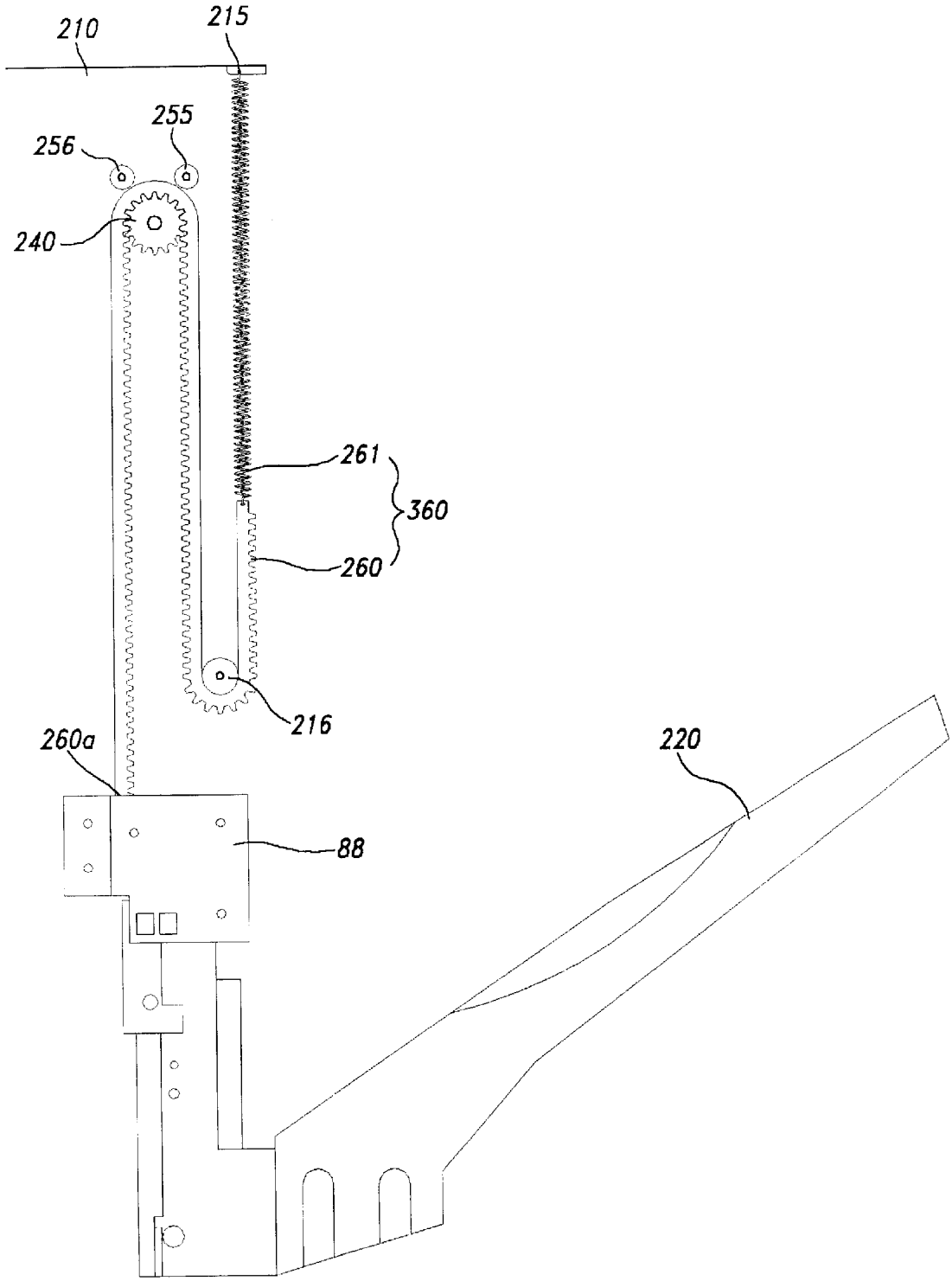
FIG. 8 is a detailed view illustrating a structure of a lifting belt according to the present invention.

As will be apparent from FIGS. 3 and 8, a spring clamp member 215 is provided at the top of the basic module frame 210. The end of the second part 261 of the lifting belt 360 is fixed to the spring clamp member 215. A fixed pulley 216 is provided at the bottom of the basic module frame 210. The lifting belt 360 is externally in contact with the fixed pulley 216. The end 260*a* of the first part 260 connected with the second part 261 is fixed to a support 88 of the stacker tray. The stacker tray ascends along the first guide plate 211 and the second guide plate 273.

Both the first part 260 and the second part 261 of the lifting belt 360 can pass through the fixed pulley 216. However, since the second part 261 is formed of a spring of an elastic member, it is desirably controlled to fail to pass through the belt driving pulley 240.

Since the lifting belt 360 is constructed by interposing the elastic member as above, the first part 260 of the lifting belt 360 movably engaged with the belt driving pulley acts to move the stacker tray 220 upwardly and the second part 261 acts to maintain tension so as not to hang the lifting belt 360 down.

Particularly, the second part 261 of the lifting belt 360 acts to fail to apply load to the belt driving pulley 240 that drives the first part 260 of the lifting belt 360, even though the object is caught in the lower part while the stacker tray 220 descends.

In more detail, to descend the stacker tray 220 along the first guide plate 211, the end 260*a* of the first part 260 fixed to the support 88 should descend downwardly. To this end, if the belt driving pulley 240 rotates counterclockwise, the second part 261 of the lifting belt increases by the moving distance of the first part.

Therefore, no load is applied to the power transmission system 250 connected with the belt driving pulley 240 even though the stacker tray is forcibly prevented from descending.

The power transmission system 250 that drives the belt driving pulley includes a worm 251 connected with a rotational shaft of the driving motor 230, a worm gear 252 engaged with the worm 251, a first driving gear 253 fixed on the same shaft as the worm gear 252, a second driving gear 254 engaged with the first driving gear 253 and fixed on the same shaft as the belt driving pulley 240 to transmit the rotational force transmitted through the first driving gear 253 to the belt driving pulley 240, and first and second adhesive rollers 255 and 256 fixed to adjoin the belt driving pulley 240, adhering the first part 260 of the lifting belt 360 to the circumference of the belt driving pulley 240.

Figure 5:
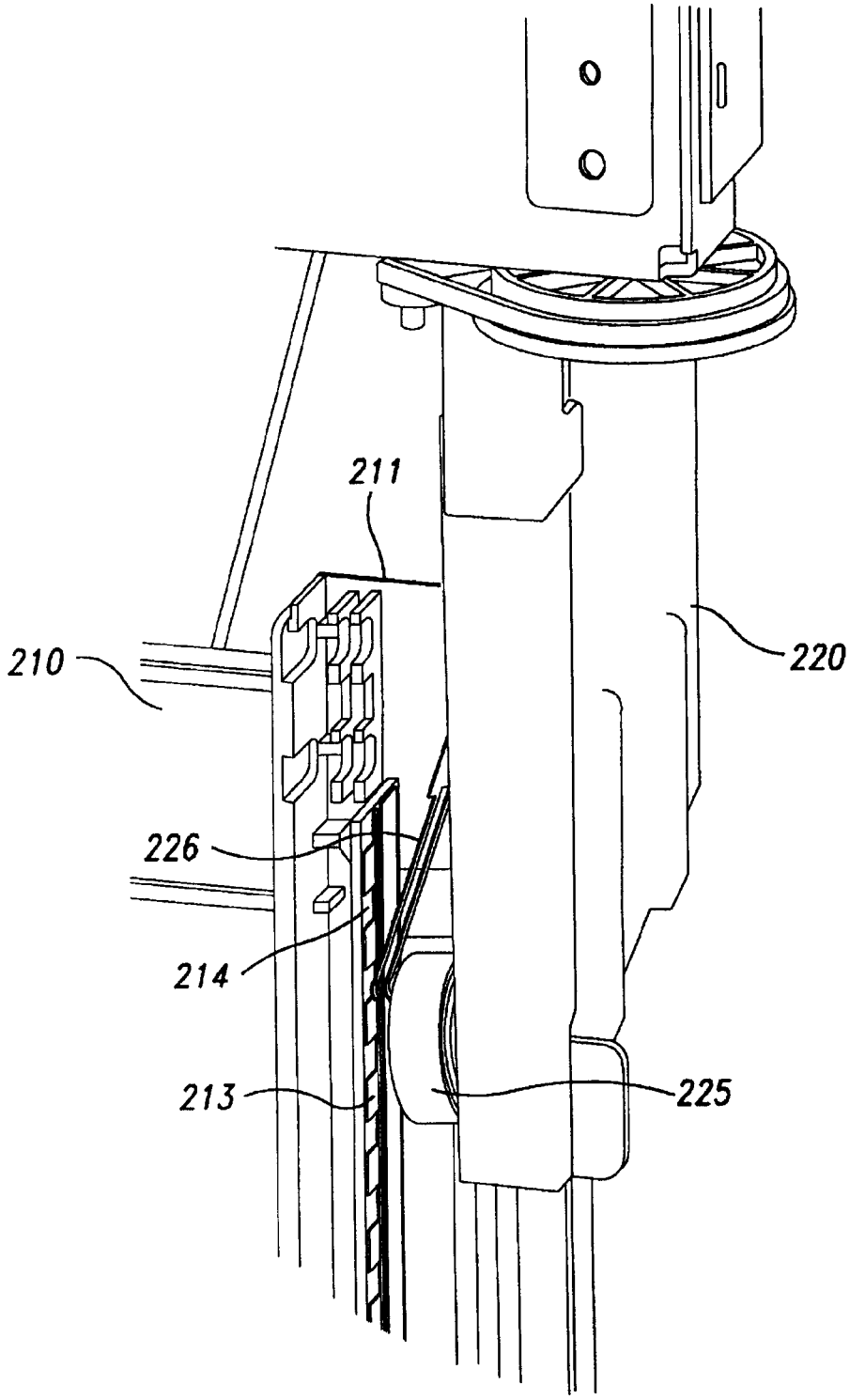
FIG. 5 is a perspective view illustrating a fixed part between a stacker tray and a basic module frame of a medium stacker according to the present invention.

FIG. 5 is a detailed view illustrating a fixed part between the basic module frame 210 and the stacker tray 220.

As shown in FIG. 5, a moving roller 225 is fixed to an inner end of the stacker tray 220 and is slidably in contact with the first guide plate 211 of the basic module frame 210.

A plate spring 226 of a conductive material is provided at a predetermined distance apart from the roller 225 and has two contact nodes which are in contact with the first sensing plate 213.

The detailed function and operation of the aforementioned medium stacker of the output device that can expand the capacity of papers will be described with reference to FIGS. 6 to 8.

Figure 6:
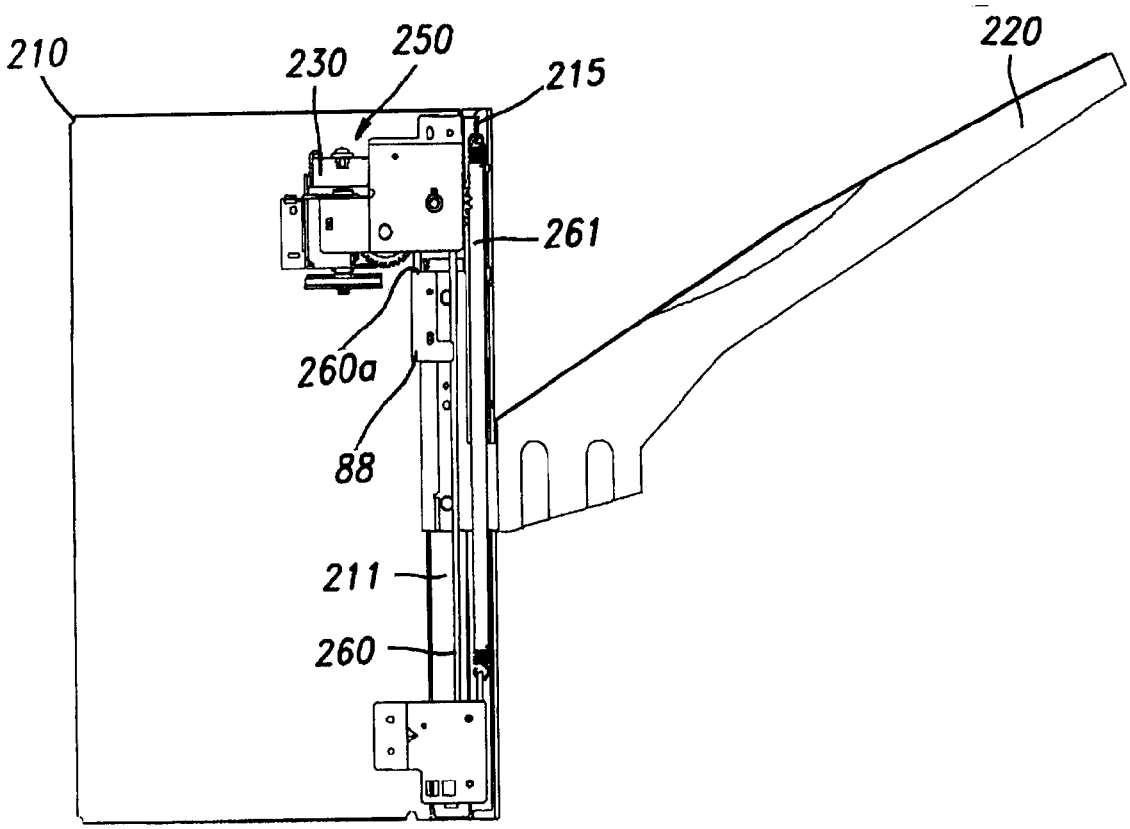
FIG. 6 is a side view illustrating the operational state of a basic module of a medium stacker according to the present invention.
Figure 7:
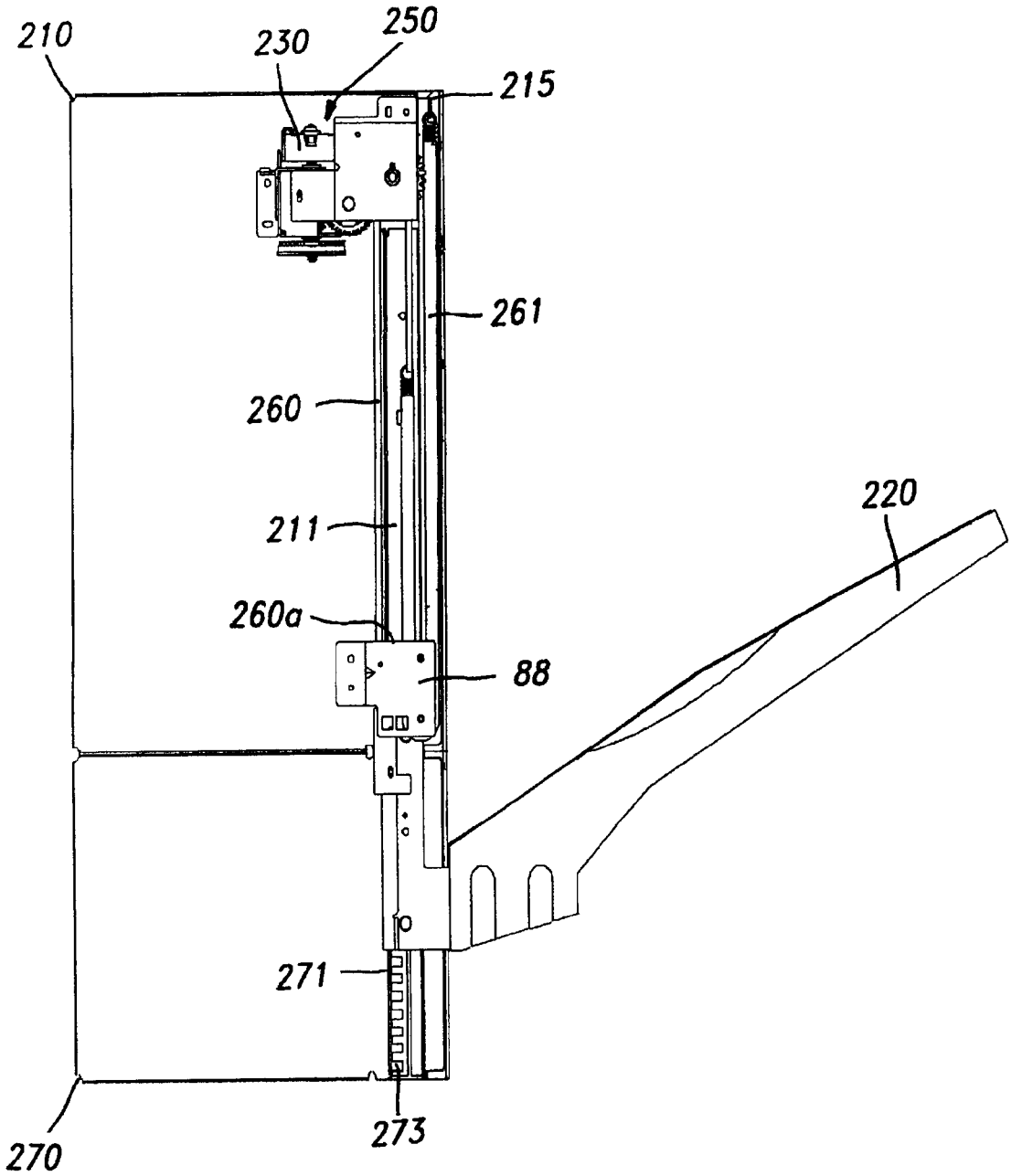
FIG. 7 is a side view illustrating the operational state of a medium stacker to which an expanding module is additionally provided in accordance with the present invention.

FIG. 6 is a side view illustrating the operational state of the basic module of the medium stacker according to the present invention, FIG. 7 is a side view illustrating the operational state of the medium stacker to which the expanding module is additionally provided, and FIG. 8 is a detailed view illustrating a structure of the lifting belt according to the present invention.

As shown in FIGS. 6 to 8, the medium stacker of the present invention may operate with the basic module only, and also may operate in a state where the expanding module is additionally provided.

When the driving motor 230 is stopped, the stacker tray 220 is supported by the first part 260 of the lifting belt 360. In this state, if the papers ejected from the main body of the output device are stacked on the stacker tray 220 in a predetermined range, the power is applied to the driving motor 230 and the lifting belt moves along the circumference of the belt driving pulley 240 by means of the rotational force transmitted from the driving motor 230 through the worm 251, the worm gear 252, the first gear 253, and the second driving gear 254. At this time, the first part 260 of the lifting belt 360 is adhered to the circumference of the belt driving pulley 240 by means of the first and second adhesive rollers 255 and 256. Thus, the power transmission can be performed without any idle.

To increase the capacity of papers stacked on the stacker tray 220, as shown in FIG. 7, the expanding module frame 270 is additionally provided at the lower part of the basic module frame 210. That is, since the first guide plate 211 formed in the basic module frame 210 is connected with the second guide plate 271 formed in the expanding module frame 270, the stacker tray 220 ascends to the expanding module 270 without changing the structure of the power transmission system in a state where it is supported by the lifting belt 360. As a result, much more papers can be stacked on the stacker tray 220.

Meanwhile, referring to FIG. 5, electrical signals between the two contact nodes of the plate spring 226 are repeatedly connected with or disconnected from each other by the first sensing plate 213 in accordance with the ascending operation of the stacker tray 220, thereby sensing the ascending position of the stacker tray 220.

If the stacker tray 220 is stopped by collision with obstacles such as the human body or peripheral objects, the electrical signals between the two contact nodes remain unchanged for a predetermined time period. Accordingly, the electrical signals are sensed to prevent the power from being applied to the driving motor 230, thereby improving stability of the device.

The same operation is also performed by the second sensing plate 273 when the stacker tray 220 moves to the expanding module frame 270.

Moreover, the stacker tray 220 is connected with the end of the non-closed curve type lifting belt 360 provided with the elastic member. Accordingly, if the stacker tray 220 is stopped as it collides with the external object or the human body, the belt driving pulley 240 continues to rotate but no load is applied to the stacker tray. As a result, damage given to the external object or the human body collided with the stacker tray 220 can be minimized.

Meanwhile, the structure of the power transmission system 250 that transmits the rotational force of the driving motor 230 to rotate the lifting belt 360 is not limited to the aforementioned embodiment. That is, gear, belt, pulley, chain, or their combination may be used as the power transmission system. Also, the structure for sensing the position of the stacker tray 220 is not limited to the first and second sensing plates 213 and 273 and the plate spring 226.

As aforementioned, the medium stacker according to the present invention has the following advantages.

The capacity of the stacker tray can simply increase by fixing the expanding module frame to the lower part of the basic module frame without any change of the driving system that drives the stacker tray.

Furthermore, since the stacker tray is supported by one end of the non-closed curve type lifting belt provided with the spring, if the stacker tray collides with the external object or the human body, no overload is applied to the driving motor and the power transmission system. As a result, it is possible to safely protect the medium stacker.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A medium stacker comprising:

a basic module frame fixed to a medium unit of a main body of an output device;

a stacker tray fixed to the basic module frame to enable the ascending operation, on which ejected papers are stacked;

a first guide means provided in the basic module frame, guiding the ascending operation of the stacker tray;

a lifting belt ascending the stacker tray along the first guide means;

a belt driving pulley fixed to the lifting belt; and a power transmission system rotating the belt driving pulley, wherein the lifting belt includes a first part moving along the belt driving pulley, fixed to the stacker tray and a second part of an elastic member which is not moving along the belt driving pulley.

2. The medium stacker according to claim 1, wherein the lifting belt has a non-closed curve type in such a way that the first part has one end fixed to the stacker tray and the second has one end fixed to the basic module frame.

3. The medium stacker according to claim 1, wherein the first part of the lifting belt is provided with teeth engaged with the belt driving pulley, and the second part is formed of a tension spring.

4. The medium stacker according to claim 1, further comprising an expanding module frame detachably fixed to the lower part of the basic module frame, the expanding module frame being provided with a second guide means connected with the first guide means.

5. The medium stacker according to claim 1, further comprising a sensing means that senses the position of the stacker tray.

6. The medium stacker according to claim 5, wherein the sensing means includes a first sensing plate of a conductive material arranged in the basic module frame in parallel with the first guide means, having slits arranged at predetermined intervals, and a plate spring of a conductive material fixed to the stacker tray, sensing the position of the stacker tray in contact with the slits of the first sensing plate in accordance with the ascending operation of the stacker tray.

7. The medium stacker according to claim 6, wherein the sensing means further includes a second sensing plate of a conductive material arranged in the basic module frame in parallel with the second guide means, having slits arranged at predetermined intervals, and the plate spring senses the position of the stacker tray in contact with the slits of the second sensing plate in accordance with the ascending operation of the stacker tray.

8. The medium stacker according to claim 1, further comprising adhesive rollers fixed to adjoin the belt driving pulley, adhering the first part of the lifting belt to the circumference of the belt driving pulley.

* * * * *

UNITED STATES PATENT AND TRADEMARK OFFICE

CERTIFICATE OF CORRECTION

PATENT NO. : 6,736,393 B2
DATED : May 18, 2004
INVENTOR(S) : Seung-Kyoon NOH

It is certified that error appears in the above-identified patent and that said Letters Patent is hereby corrected as shown below:

Title page,
Item [30], insert the following:
-- [30] Foreign Application Priority Data
Oct. 31, 2001 (KR) ….. 2001-67692 --.

Signed and Sealed this

Thirteenth Day of July, 2004

JON W. DUDAS
*Acting Director of the United States Patent and Trademark Office*